US005692429A

United States Patent [19]

Sonntag

[11] Patent Number: 5,692,429

[45] Date of Patent: Dec. 2, 1997

[54] FLUID-POWERED CYLINDER

[75] Inventor: Udo Sonntag, Kamp-Lintfort, Germany

[73] Assignee: IMI Norgren GmbH, Germany

[21] Appl. No.: 544,641

[22] Filed: Oct. 18, 1995

[30] Foreign Application Priority Data

Oct. 18, 1994 [GB] United Kingdom ..... 9421002

[51] Int. Cl.[6] ..... F15B 15/22

[52] U.S. Cl. ..... 91/395; 91/407; 92/85 B; 92/88

[58] Field of Search ..... 91/395, 405, 407, 91/408; 92/85 R, 85 B, 88

[56] References Cited

U.S. PATENT DOCUMENTS

| | | | |
|---|---|---|---|
| 2,870,744 | 1/1959 | Hallerstrom | 91/407 |
| 3,054,385 | 9/1962 | Hanna | 91/359 |
| 3,136,225 | 6/1964 | Rader | 91/395 |
| 4,043,787 | 8/1977 | Foster | 91/408 |
| 4,373,427 | 2/1983 | Garlapaty et al. | 92/88 |

*Primary Examiner*—F. Daniel Lopez

*Attorney, Agent, or Firm*—Cushman Darby & Cushman IP Group of Pillsbury Madison & Sutro, LLP

[57] ABSTRACT

A double-acting pneumatic cylinder is characterised by the provision of a pair of sealing elements respectively located on either side of the piston by means of rods slidably mounted in longitudinal bores formed in the piston. At the commencement of the cylinder's in-stroke, the rod and its associated sealing element is in an extended position and serves to seal off the main exhaust port while the piston is still relatively distantly located from the end of its in-stroke. During further in-stroking the piston, air can therefore exhaust only through the auxiliary exhaust port and the motion is thus cushioned. The out-stroke of the cylinder is similarly cushioned over a relatively large distance by virtue of the sealing element adopting an extended position and closing off the main exhaust port, the air exhausting through the auxiliary exhaust port.

4 Claims, 4 Drawing Sheets

FLUID-POWERED CYLINDER

This invention relates to fluid-powered cylinders especially, but not exclusively, pneumatic cylinders.

It is well known to damp or "cushion" the motion of a pneumatic cylinder as it approaches the end of a stroke. The main purpose of such cushioning is to prevent possible damage to the load being actuated by the cylinder and/or to the cylinder itself as could occur if the piston were to strike the end of the cylinder body at high velocity. Usually, the cushioning comes into effect only fractionally before the end of each stroke. However, there are applications where it would be desirable to afford cushioning over an extended length, but this is not possible or practicable using conventional cushioning techniques. It is an object of the present invention to provide an arrangement for affording an extended degree of cushioning in a fluid-powered, for example pneumatic, cylinder.

According to the present invention, therefore, there is provided a fluid-powered cylinder comprising a body having a bore therein, a piston longitudinally reciproacable in the bore and having a motion transfer element secured thereto, a main fluid exhaust passageway and an auxiliary fluid exhaust passageway located at one end of the bore, and sealing means carried by the piston for closing off said main exhaust passageway at a predetermined stage during motion of the piston towards said end whereby, during further motion of the piston towards said end, fluid can exhaust only through the auxiliary exhaust passageway thus cushioning said further motion of the piston towards said end, characterised in that the piston has longitudinally mounted therein elongate support means fixedly supporting at one end thereof said sealing means, the support means and the piston being longitudinally slidable relative to one another between a first position in which the sealing means is located adjacent to the piston and a second position in which it is located remotely from the piston, and means to move the support means from said first position into said second position prior to or during initial movement of the piston towards said one end of the bore, during which further motion towards said one end the piston can move longitudinally relative to the support means until said first position is attained whilst the sealing means remains stationary and closes off the main exhaust passageway.

In principle, a cylinder constructed in accordance with the present invention may be a single acting cylinder, that is to say a cylinder which affords a power stroke only in one direction, being returned in the opposite direction by, for example, a compression spring. Much more usually, however, it will be a double-acting cylinder, that is to say one that affords a power stroke in each direction of its movement. Hereinafter, the specification will refer to the latter type in which both opposed ends of the bore will have a fluid inlet passageway, a main exhaust passageway and an auxiliary exhaust passageway whereby each stroke may be cushioned although, less usually, the arrangement may be such that only one of its strokes is cushioned by means according to the invention. As is conventional, the fluid inlet passageway and the main exhaust passageway will usually be defined by one and the same passageway, its function at any particular time being controlled as appropriate by a directional control valve in accordance with well-established practice. The motion transfer element may be a piston rod or the transfer element of a so-called rodless cylinder, again as is conventional.

As indicated above, both ends of the bore will usually have an auxiliary exhaust passageway whereby cushioning may be effected during each power stroke by providing a further sealing means arranged to function as aforesaid. As in conventional cushioned cylinders, the auxiliary exhaust passageway has a much smaller cross-sectional area than the main exhaust passageway and is in the nature of a bleed passageway preferably provided with an adjustable throttle device.

As will be apparent, in a cylinder constructed in accordance with the present invention, the length of the piston stroke during which cushioning is effected may be much greater than in conventional designs where it is effected only fractionally before the end of each stroke. The extended degree of cushioning is useful in a number of applications, including for example pneumatically operated railway carriage doors.

Embodiments of the invention will now be described by way of example only with reference to the accompanying drawings in which.

Figure 1:
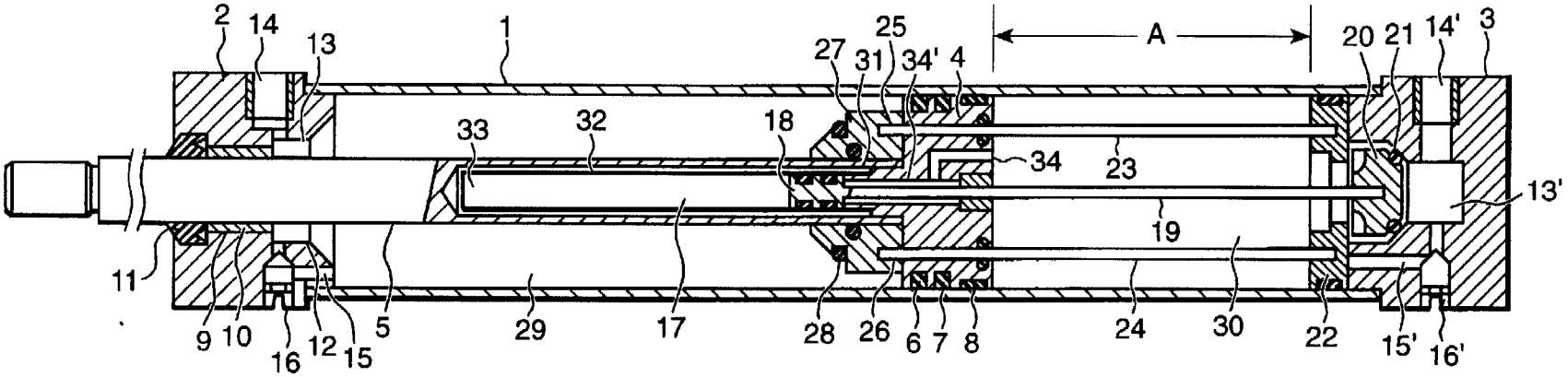
FIG. 1 is a sectional side elevation of a double acting pneumatic cylinder constructed in accordance with the invention during its in-stroke wherein the main exhaust passageway sealing means is actuated mechanically and pneumatically.

Referring first to FIG. 1, the cylinder comprises a cylindrical body 1 which is closed at each end by respective end caps 2 and 3. A piston 4 is axially slidably located in the bore of the body 1 and has a piston rod 5 secured to it. An air-tight seal is formed between the external cylindrical surface of the piston 4 and the bore wall of the body 1 by means of a series of annular sealing rings 6, 7 and 8 located in annular grooves formed in the piston 4.

The piston rod 5 extends through a bore 9 formed in the end cap 2 in which is located an annular bearing member 10 and an annular seal 11. The inner end of the bore 9 is enlarged at 12 so as to define, about the piston rod 5, an annular passageway 13 which communicates with a threaded main inlet/exhaust port 14 formed in the end cap 2. The end cap 2 is further formed with an auxiliary bleed passageway 15 that communicates with the annular passageway 13 via an adjustable, tapered throttle screw 16.

The end cap 3 is similarly provided with corresponding passageways 13' and 15', a main inlet/exhaust port 14' and an adjustable throttle screw 16'.

The features described above are, as will be appreciated, in general terms comprised in conventional double acting cylinders that provide for cushioning of the in and out-stroke fractionally before the end of the respective strokes. In accordance with the present invention, however, means are provided for affording cushioning over an extended part of each stroke. More particularly, a hollow part of the length of the piston rod 5 coaxially houses a cylinder 17 in which is sealingly, and axially slidably, mounted a small piston 18. The piston 18 is formed integrally with a piston rod 19 which extends axially through the piston 4 and which supports at its end remote from the piston a sealing member 20. The sealing member 20 carries, on a forward bevelled face thereof, an O-ring 21 that seals off the passageway 13' during part of the in-stroke of the cylinder. FIG. 1, in fact, shows the position of the sealing member 20 at the commencement of cushioning during the in-stroke.

The cylinder further includes an annular guide member 22 which is located as a sliding fit in the cylindrical body 1. The guide member 22 surrounds the piston rod 19 and has secured to it the ends of two tie rods 23 and 24 that extend, as a sealed sliding fit, through two bores 25 and 26 respectively formed longitudinally in the piston 4. The other ends of the tie rods 23 and 24 are secured to a sealing member 27 sealingly mounted as a sliding fit on the piston rod 5. The sealing member 27 carries an O-ring 28. The assembly of parts 22, 23, 24, 27 and 28 serve to afford cusioning over an extended part of the out-stroke of the pneumatic cylinder, just as the assembly of parts 17 to 21 do during the cylinder's in-stroke, as will now be described in more detail.

Considering now FIG. 1 in detail which, as already noted, shows the cylinder during execution of its in-stroke, it can be seen that the piston rod 19/sealing member 20 are in a fully extended position. This position is in fact, attained during the cushioned stage of the previous out-stroke (see the description below with reference to FIG. 3). In order to effect the in-stroke, compressed air is fed into the left hand chamber 29 of the cylinder via a conventional directional control valve (not shown), the port 14 and the passageway 13. At the same time, the port 14' is connected to atmosphere by means of the directional control valve whereby air in the right hand chamber 30 of the cylinder can exhaust via the passageway 13' and the port 14'. For reasons that will be described later, a small radial bore 31 is formed in the wall of the hollow part of the piston rod 5, and this communicates with the cylinder 17 via an annular channel 32 defined between that wall and the cylinder 17 and the open end 33 of the cylinder 17. Further, the other end of the cylinder 17 communicates with a passageway 34 formed in the piston 4, via an annular passageway 34'.

Figure 2:
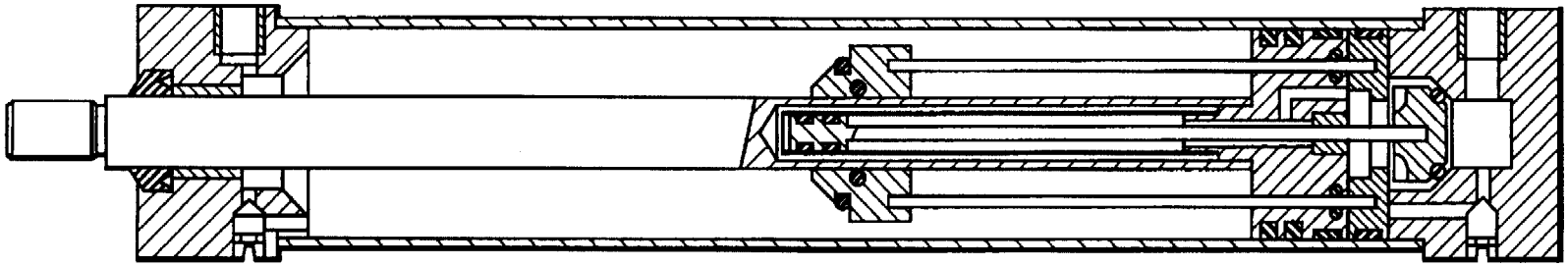
FIG. 2 is a similar view to that of FIG. 1 but showing the cylinder at the end of its in-stroke.

The cylinder continues its in-stroke at its full, desired velocity until it eventually reaches the position actually shown in FIG. 1 whereupon cushioning of the in-stroke motion becomes effective over the distance marked 'A'. Thus, the main entrance to passageway 13' becomes sealed off by the seal 21 carried by the member 20 and, upon continued in-stroke movement of the piston 4, air in the chamber 30 can exhaust through the port 14' only via the bleed passageway 15'/throttle screw 16'. The velocity of the piston 4 thereby reduces by an amount dependant upon the setting of the throttle screw 16'. The cylinder then completes in its in-stroke in cushioned fashion and in so doing the piston 4 slides over the piston rod 19 whereby the piston 18, the piston rod 19 and the sealing member 20 eventually re-assume their fully retracted position. FIG. 2, from which the reference numerals have been omitted for clarity, shows the cylinder at the end of its in-stroke.

At the beginning of the cushioned phase of the cylinder's in-stroke, it can be seen from FIG. 1 that the guide member 22 abuts the inner face of the end cap 3 and that the sealing member 27 abuts the left hand face of the piston 4, i.e. that the member 27 is in a fully retracted position relative to the piston 4. This position will have been attained at the end of the cylinder's previous out-stroke. However, during the cushioned phase of the in-stroke, the piston 4 slides over the tie rods 23, 24 and, at the end of that stroke, abuts the guide member 22 which indeed determines the limit of the in-stroke. Thus, the sealing member 27 attains its fully extended position relative to the piston 4 in readiness for execution of the out-stroke.

Figure 3:
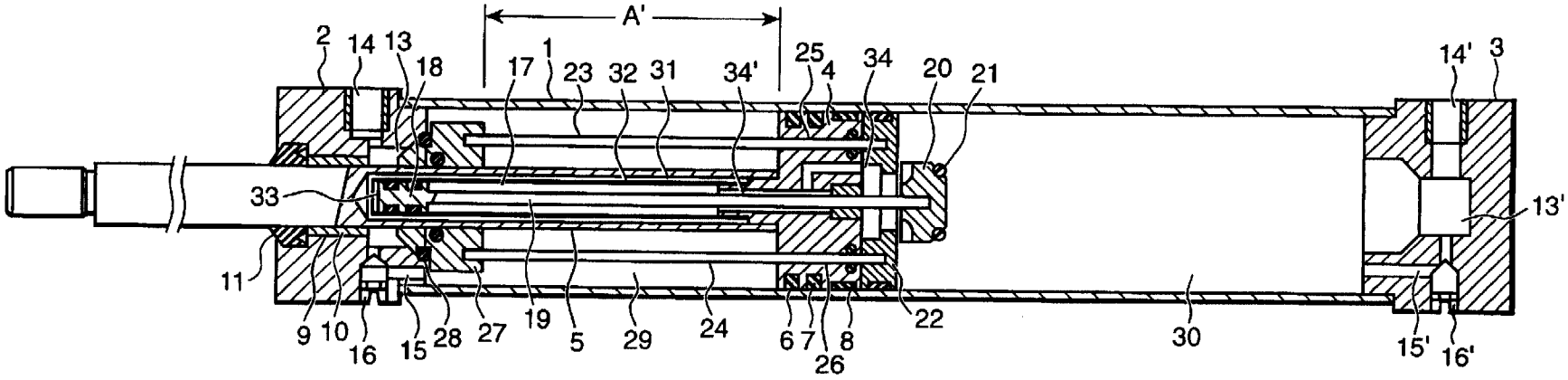
FIG. 3 is a similar view to that of FIGS. 1 and 2 but showing the cylinder during its out-stroke.

Referring additionally to FIG. 3, which shows the cylinder during its out-stroke, the out-stroke is effected by change-over of the directional control valve such that compressed air is fed to the port 14' whilst the port 14 becomes connected to the atmosphere (exhaust). Initially, the sealing member 20 will be axially displaced leftwards and full flow of the compressed air into the chamber 30 will then occur via the passageway 13'. The out-stroke therefore proceeds at its full desired velocity until the position shown in FIG. 3 is reached. In this position, the O-ring 28 mounted in the sealing member 27 closes of the main entrance to the passageway 13 and air in the chamber 29 can exhaust only via the passageway 15 and the throttle screw 16. The out-stroke thereby becomes cushioned and will continue to be cushioned for the remainder of the length of the out-stroke marked A' in FIG. 3 during which the piston 4 slides over the tie rods 23 and 24 until it abuts the inner face of the sealing member 27 which serves as the limit for the out-stroke of the cylinder. Simultaneously, the piston 18 will of course assume, relative to the cylinder 17, the position shown in FIG. 1, i.e. its fully extended position, in readiness for the next in-stroke.

The sequence described above refers to the case where the cylinder fully executes both an in-stroke and an out-stroke. However, extended cushioning of a subsequent stroke occurs even if the previous stroke is not fully completed. Thus, and with reference to FIG. 1 of the drawing, if, for example, in the position shown in FIG. 1, the cylinder were, by change-over of the directional control valve, to perform an out-stroke, compressed air in the chamber 30 will enter the right-hand end of the cylinder 17 via the passageways 34 and 34' thereby moving the piston 18 leftwards, air in the left-hand part of the cylinder 17 exhausting to atmosphere via the bore 31, the chamber 29 and the port 14. Such movement of the piston 18 will cause the sealing member 27 likewise to move fully leftwards, i.e. to bring the sealing member 27 into its fully extended position relative to the piston 4. Accordingly, that particular out-stroke will be subjected to cushioning potentially over the full length A'.

Similarly, if an out-stroke were not fully completed before change-over to an in-stroke, the sealing member 20 would be brought into an extended position relative to the piston 4 by virtue of compressed air in the chamber 29 entering the left-hand part of the cylinder 17 via the bore 31, air in the right-hand port of the cylinder 17 exhausting via the passageways 34', 34, the chamber 30 and the port 14'. The in-stroke would thereby be subjected to cushioning potentially over the whole length A.

Pneumatic actuation of the sealing members 20 and 27 into extended positions relative to the piston 4, as just described, will, of course occur regardless of the position of the piston 4 during change over from an incompleted in-stroke to an out-stroke and vice-versa.

As will be appreciated, the arrangements described above afford cushioning over an extended length of each stroke of the cylinder. The length (A and A') of the stroke over which cushioning occurs may, of course, be varied by the varying the lengths of the piston rod 19 and the tie rods 23 and 24, as may the degree of cushioning by appropriately adjusting the throttle screws 16 and 16'.

Figure 4:
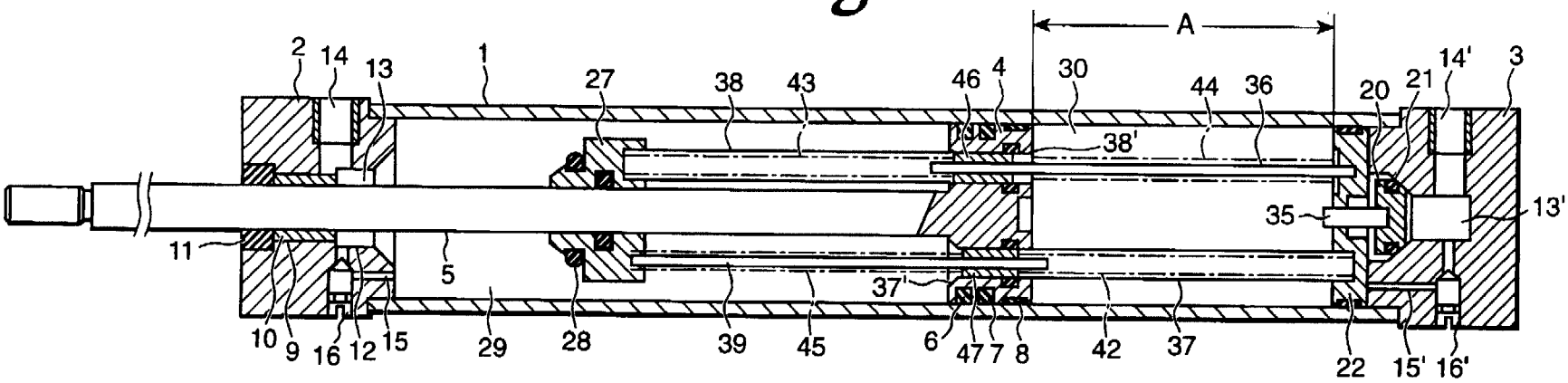
FIGS. 4 to 6 are similar views to, respectively, FIGS. 1 to 3 but wherein the main exhaust passageway sealing means is actuated purely mechanically by means of compression springs.
Figure 5:
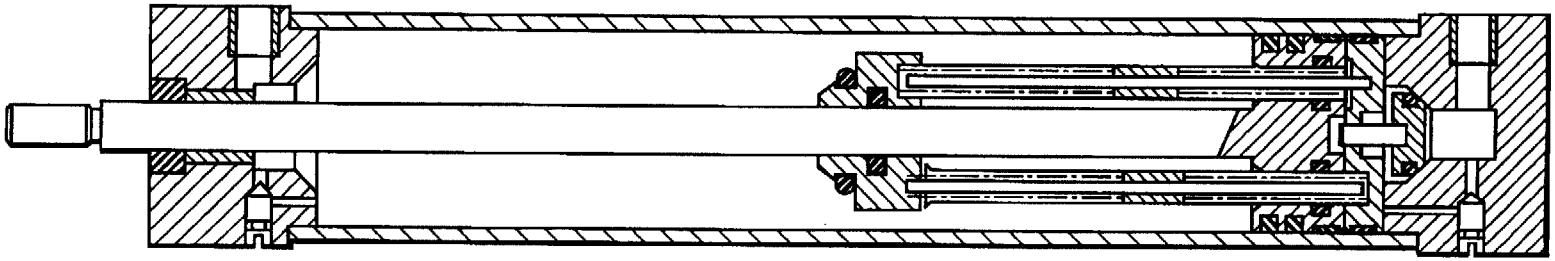
Figure 6:
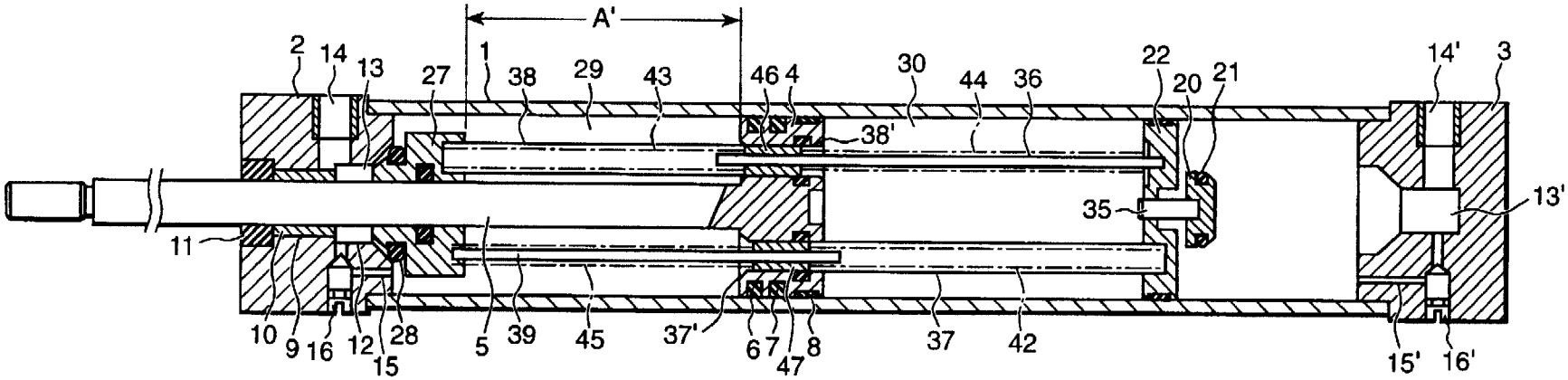

FIGS. 4 to 6 depict a double-acting pneumatic cylinder that is essentially the same as the cylinder shown in FIGS. 1 to 3 but wherein positioning of the sealing members 20 and 27 is controlled purely mechanically. In FIGS. 4 and 6, parts corresponding to those in FIGS. 1 and 3 bear the same respective reference numerals.

Referring first to FIG. 4, which shows the cylinder at the commencement of cushioning during the in-stroke, the sealing member 20 and its O-ring 21 are mounted on a spigot 35 secured o e guide member 22. The guide member 22 has secured to it one end of a tie rod 36 and one end of a tube 37. The other ends of the tie rod 36 and tube 37 are telescopically engaged with, respectively, a second tube 38 and a second tie rod 39 on the respective ends of which, remote from the guide member 22, is mounted the sealing member 27. The tubes 37 and 38 are slidably mounted in bores 40, 41 formed in the piston 4. However, rightwards movement of the tube 37 relative to the piston 4, and leftwards movement of the tube 38 relative to the piston 4, are limited by virtue of the tube ends being flared at 37' and 38' respectively.

Each of the tubes 37, 38 houses, and each tie rod 36, 39 is surrounded by, respective identical compression springs, 42, 43, 44 and 45. The adjacent ends of the springs 43 and 44 abut a cylindrical spacer 46 slidably mounted on the tie rod 36 and in the tube 38, whereas the adjacent ends of the springs 42 and 45 abut a like spacer 47 slidably mounted on the tie rod 39 and in the tube 37.

In the position shown in FIG. 4 both sealing members 20 and 27 are urged into their fully extended positions by the compression springs 42 to 45 and, in particular, the sealing member 20/seal 21 closes off the main entrance to the passageway 13'. Upon continued supply of compressed air to the chamber 29 the piston 4 continues its in-stroke, in cushioned fashion, for the distance marked A whereupon the tie rods 36 and 39 become fully telescoped Within the tubes 38 and 37 respectively and the springs 42 and 45 become equally compressed. FIG. 5, from which the reference numerals have been omitted for clarity, show the cylinder at the end of its in-stroke.

FIG. 6 shows the arrangement at the commencement of cushioning during the out-stroke. Here, it can be seen that, as in FIG. 4, the sealing members 20 and 27 are both in their fully extended positions but upon continued supply of compressed air to the chamber 30, the piston 4 continues its out-stroke, in cushioned fashion, over the distance A', whereupon the tie rods 36 and 39 again become fully telescoped within the tubes 38 and 37 respectively and the springs 42 and 45 become equally compressed.

Accordingly, cushioning is again afforded over an extended length (A or A') of each stroke of the cylinder and this may be varied by varying the lengths of the tubes 37 and 38 and the tie rods 36 and 39.

As will be appreciated, the FIGS. 4 to 6 embodiment also provides for extended cushioning of a subsequent stroke even if the previous stroke is not completed. This feature, as in the case of the FIGS. 1 to 3 embodiment, is useful in the context of passenger railway carriage doors actuated by cylinders of the invention where, because of an obstruction by a passenger during closing of the doors, they are caused to re-open and then close once the passenger is clear of the doors.

FIGS. 7(*a*) and 7(*b*) illustrate an extended cushioning arrangement that is especially suitable for use with so-called rodless cylinders which may be of any known type such as, for example, the type described and claimed in European patent specifications Nos 68088 and 69199 to which the reader is referred.

Figure 7A:
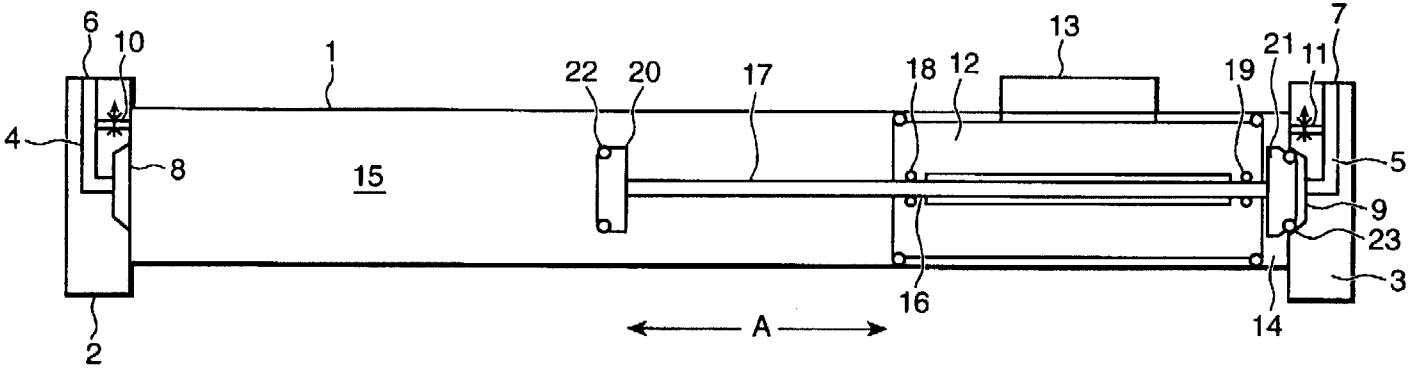
FIGS. 7(*a*) and 7(*b*) are schematic sectional side elevations that illustrate respectively two further pneumatic cylinders constructed in accordance with the invention.
Figure 7B:
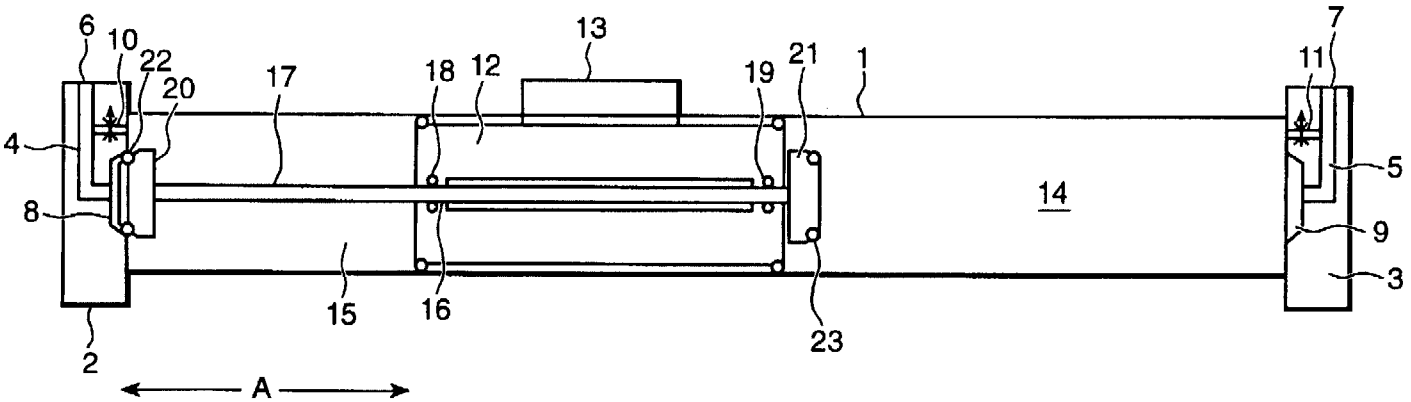

Referring to FIGS. 7*a* and 7*b*, the rodless cylinder comprises an elongate hollow cylindrical body 1, for example in the form of an aluminium extrusion, which is closed by end caps 2 and 3. The end caps 2 and 3 are formed with respective passageways 4 and 5 which at their outer ends are threaded at 6 and 7 respectively for connection to a directional control valve (not shown), as is conventional. The inner ends of the passageways 4 and 5 terminate in, respectively, enlarged tapered ports 8 and 9 which constitute the main inlet/exhaust ports.

Each of the end caps 2 and 3 is also formed with an auxilliary exhaust passageway 10 and 11 respectively which is provided with a throttle which is fixed, or as shown in the drawings, adjustable, The hollow cylindrical body 1 defines a bore having slidably mounted in it a main piston assembly 12 to which is secured a motion transfer element 13. The motion transfer element 13 projects through a sealed slot formed in, and extending along the whole of the length of, the body 1. Further details of the construction and operation of this type of rodless cylinder may be found in, for example, the above European patent specifications.

The main piston assembly 12 thus partitions the cylinder bore into right- and left-hand chambers 14 and 15 respectively into which compressed air is alternately fed, by way of the directional control valve, in order to actuate the cylinder and cause it to perform reciprocating strokes.

The main piston assembly 12 is formed with an axial bore 16 in which is slidably mounted a rod (or tube) 17. O-ring seals 18 and 19 are provided at opposite ends of the bore 16 and not only provide a fluid seal but also frictionally engage the rod 17.

The opposite ends of the rod 17 are provided with sealing members 20, 21 respectively each having a tapered face supporting O-ring seals 22, 23 respectively.

The slidable rod/sealing members assembly provides for cushioning of the cylinder's stroke over an extended length, as will now be described in more detail.

Considering first FIG. 7*a*, this shows the rodless cylinder at the end of its rightwards stroke in which it can be seen that the sealing member 21 sealingly engages the port 9 and in which the main piston assembly 12 abuts the sealing member 21. On the other hand, it can be seen that the sealing member 20 is located remotely from the main piston assembly 12 by a distance A. In order to cause the piston assembly 12, and hence the motion transfer element 13, to execute its leftwards stroke, compressed air is fed into the chamber 14 via the directional control valve, the passageway 5 and the port 9. At the same time, the chamber 15 is connected to atmosphere (exhaust) via the port 8, the passageway 4 and the directional control valve. After the sealing member 21 has been dislodged from engagement with the port 9, the piston assembly 12 moves to the position shown in FIG. 7*b*, carrying the rod 17/sealing members 20, 21 with it in the same relative position.

In the position shown in FIG. 7*b*, it can be seen that the sealing member 20/O-ring 22 now sealingly engages the port 8, thus closing off the main path to exhaust. However, upon continued movement of the piston assembly 12, exhaust of air in the chamber 15 continues to occur via the auxilliary exhaust passageway 10, but at a much reduced rate. Accordingly, the speed of the piston assembly 12 reduces considerably, i.e. its movement is cushioned for a distance A. Upon such continued, cushioned, movement of the piston assembly 12, it does of course slide over the rod 17 until it abuts the sealing member 20, thereby reaching the end of its leftwards stroke. Now, the sealing member 21 will be in a position remote from the piston assembly 12 and is ready to provide cushioning, again over a length A, during the next rightwards stroke of the rodless cylinder which is effected by change-over of the directional control valve in the usual manner.

Extended cushioning is therefore provided by this very simple arrangement and the length A of each stroke during which cushioning occurs may be varied simply by varying the length of the rod 17 as desired.

As in the embodiments specifically described with reference to FIGS. 1 to 6, the full extent A or A' of cushioning can occur during a stroke even if the immediately preceding stroke is not fully completed. Thus, even if, say, the leftwards stroke is not fully completed, the rod 17 will, simultaneously with commencement of the succeeding rightwards stroke, move fully rightwards by virtue of the differential pressure across it until the sealing member 20 abuts the left hand face of the main piston assembly 12.

I claim:

1. A fluid-powered cylinder comprising:

a body having a bore therein, a piston longitudinally reciprocable in the bore and having secured thereto a piston rod extending axially of the body from one side of the piston, a main fluid exhaust passageway and an auxiliary fluid exhaust passageway located at one end of the bore, and sealing means carried by the piston for closing off said main exhaust passageway at a predetermined stage during motion of the piston towards said end, whereby, during further motion of the piston towards said end, fluid can exhaust only through the auxiliary exhaust passageway thus cushioning said further motion of the piston towards said end, wherein the piston has longitudinally mounted therein elongate support means fixedly supporting at one end thereof said sealing means located on the other side of the piston, the support means and the piston being longitudinally slidable relative to one another between a first position in which the sealing means is located adjacent to the piston and a second position in which it is located remotely from the piston, and means to move the support means from said first position into said second position prior to or during initial movement of the piston towards said one end of the bore, during which further motion towards said one end the piston can move longitudinally relative to the support means until said first position is attained whilst the sealing means remains stationary and closes off the main exhaust passageway, and wherein the elongate support means extends axially through the piston with its other end being slidably and sealingly received in an axial bore in the piston rod, the cylinder further comprising a fluid supply passageway for transmitting pressurized operating fluid from the bore in the cylinder body to the axial bore in the piston rod whereby said elongated support means and said sealing means are caused to move into said second position by the action of said operating fluid in said other end of the support means located in the axial bore in the piston rod.

2. A fluid-operated cylinder according to claim 1 wherein motion of the piston in both directions is adapted to be cushioned, the cylinder also comprising, on said one side of the piston, further sealing means secured to an end of further elongate support means longitudinally slidably mounted in the piston, said further support means/further sealing means being moveable, prior to or during initial movement of the piston towards the other end of the cylinder, between a first position in which the further sealing means is located adjacent to the piston and a second position in which the further sealing means is located remotely from the piston, said further sealing means serving to close off a further main exhaust passageway located at the other end of the bore in the body whereby, during further motion of the piston towards said other end, fluid can exhaust only through a further auxiliary exhaust port also located at said other end of the bore in the body.

3. A fluid-operated cylinder according to claim 2 wherein said further support means/further sealing means is movable between its first and second positions by virtue of movement of the piston relative thereto during movement of the piston towards said one end or by co-operation with the other support means/sealing means upon the supply of fluid pressure to the axial bore in the piston rod thus causing the other support means/sealing means to move from its second to its first position.

4. A fluid-powered cylinder comprising:

a body having a bore therein, a piston longitudinally reciprocal in the bore and having a motion transfer element secured thereto, respective main fluid exhaust passageways and auxiliary fluid passageways located at each end of the bore, and respective sealing means carried by the piston for closing off the operative one of the said main exhaust passageways at a predetermined stage during motion of the piston towards a respective end of the bore whereby, during further motion of the piston towards said respective end, fluid can exhaust only through the operative one of said auxiliary exhaust passageways thus cushioning said further motion of the piston towards said respective end, wherein each of said sealing means if fixedly supported at one end of respective elongate support means therefor, said support means being longitudinally slidably mounted in the piston between a first position in which the sealing means is located adjacent to the piston and a second position in which the sealing means located remotely from the piston, and means to urge the support means from said first position into said second position prior to or during initial motion of the piston towards a respective end of the bore, during which further motion of the piston, the piston can move longitudinally relative to the respective support means until said first position is attained whilst the respect sealing means remains stationary and closes off the respective main exhaust passageway, and wherein said respective elongate support means are telescopically engaged with one another and are urged towards or into their respective second positions by compression spring means.

* * * * *